US007846224B2

(12) United States Patent
Colucci et al.

(10) Patent No.: US 7,846,224 B2
(45) Date of Patent: Dec. 7, 2010

(54) METHODS TO IMPROVE THE LOW TEMPERATURE COMPATIBILITY OF AMIDE FRICTION MODIFIERS IN FUELS AND AMIDE FRICTION MODIFIERS

(75) Inventors: William Colucci, Glen Allen, VA (US); Kyle Fricke, Richmond, VA (US)

(73) Assignee: Afton Chemical Intangibles, LLC, Richmond, VA (US)

( * ) Notice: Subject to any disclaimer, the term of this patent is extended or adjusted under 35 U.S.C. 154(b) by 1022 days.

(21) Appl. No.: 11/640,948

(22) Filed: Dec. 19, 2006

(65) Prior Publication Data

US 2007/0094921 A1 May 3, 2007

Related U.S. Application Data

(63) Continuation-in-part of application No. 10/421,006, filed on Apr. 22, 2003, now Pat. No. 7,435,272, which is a continuation-in-part of application No. 10/128, 529, filed on Apr. 24, 2002, now Pat. No. 6,866,690.

(51) Int. Cl.
*C10L 1/22* (2006.01)

(52) U.S. Cl. ..... 44/418

(58) Field of Classification Search ..... 44/418
See application file for complete search history.

(56) References Cited

U.S. PATENT DOCUMENTS

| | | | | |
|---|---|---|---|---|
| 2,252,889 | A | | 8/1941 | Haseltine |
| 2,433,243 | A | | 12/1947 | Peters et al. |
| 3,030,195 | A | | 4/1962 | Ewan |
| 3,055,746 | A | | 9/1962 | Eckert |
| 3,282,939 | A | * | 11/1966 | Spivack et al. ..... 544/176 |
| 3,429,673 | A | | 2/1969 | Reese et al. |
| 3,442,630 | A | | 5/1969 | Annable et al. |
| 3,658,707 | A | | 4/1972 | Delafield |
| 3,785,790 | A | | 1/1974 | Strang |
| 3,873,278 | A | | 3/1975 | Polss |
| 3,893,825 | A | | 7/1975 | Goeller |
| 3,996,024 | A | | 12/1976 | Coon et al. |
| 4,086,172 | A | | 4/1978 | Lowe |
| 4,129,508 | A | | 12/1978 | Friihauf |
| 4,185,594 | A | | 1/1980 | Perilstein |
| 4,204,481 | A | | 5/1980 | Malec |
| 4,208,190 | A | | 6/1980 | Malec |
| 4,211,534 | A | | 7/1980 | Feldman |
| 4,231,883 | A | | 11/1980 | Malec |
| 4,280,916 | A | | 7/1981 | Richards et al. |
| 4,406,803 | A | | 9/1983 | Liston et al. |
| 4,409,000 | A | | 10/1983 | LeSuer |
| 4,427,562 | A | | 1/1984 | Horodysky et al. |
| 4,428,182 | A | | 1/1984 | Allen et al. |
| 4,512,903 | A | | 4/1985 | Schlicht et al. |
| 4,581,039 | A | | 4/1986 | Horodysky |
| 4,589,992 | A | | 5/1986 | Phillips et al. |
| 4,617,026 | A | | 10/1986 | Schaub et al. |
| 4,729,769 | A | | 3/1988 | Schlicht et al. |
| 4,789,493 | A | | 12/1988 | Horodysky |
| 4,808,196 | A | | 2/1989 | Horodysky |
| 4,836,829 | A | | 6/1989 | Zimmerman et al. |
| 4,867,752 | A | | 9/1989 | Braid et al. |
| 5,425,789 | A | | 6/1995 | Lewtas et al. |
| 5,679,116 | A | | 10/1997 | Cunningham et al. |
| 5,858,029 | A | | 1/1999 | Oumar-Mahamet et al. |
| 5,968,211 | A | | 10/1999 | Schilowitz |
| 6,169,064 | B1 | | 1/2001 | Krogh et al. |
| 6,277,158 | B1 | | 8/2001 | McLean |
| 6,328,771 | B1 | | 12/2001 | Moreton |
| 6,866,690 | B2 | | 3/2005 | Aradi et al. |
| 7,208,022 | B2 | | 4/2007 | Corkwell et al. |

FOREIGN PATENT DOCUMENTS

| | | | |
|---|---|---|---|
| CA | 2 388 065 | A1 | 5/2000 |
| CA | 2352705 | | 5/2002 |
| DE | 1 021 525 | | 12/1957 |
| DE | 1 645 886 | | 6/1971 |
| DE | 199 55 651 | A1 | 5/2001 |
| EP | 0 303 862 | A1 | 2/1989 |
| EP | 0 482 253 | A1 | 4/1992 |
| EP | 0 798 364 | A1 | 10/1997 |
| EP | 0 829 527 | A1 | 3/1998 |
| EP | 0 869 163 | A1 | 10/1998 |
| EP | 1295933 | | 3/2003 |
| EP | 1 357 170 | A2 | 10/2003 |
| FR | 77 17792 | | 4/1979 |
| GB | 757753 | | 9/1956 |
| GB | 767 596 | | 2/1957 |
| JP | 62768/78 | | 12/1979 |
| JP | 302660/94 | | 5/1996 |
| WO | WO 98/11175 | | 3/1998 |
| WO | WO 01/38463 | A1 | 5/2001 |
| WO | WO 01/72930 | A2 | 10/2001 |
| WO | WO 03/068895 | A1 | 8/2003 |

OTHER PUBLICATIONS

Derwent Publications Ltd., London, GB; AN 1973-30062U; XP002267365 & JP 48 015783 B (Mitsubishi Chemical Inds.).

*Comprehensive Organic Transformations, A Guide to Functional Group Preparations, by Richard C. Larock, pp. 972-976, 1989.

* cited by examiner

*Primary Examiner*—Cephia D Toomer
(74) *Attorney, Agent, or Firm*—Berenato & White, LLC

(57) ABSTRACT

The present disclosure provides an amide friction modifier which exhibits improved low temperature compatibility with fuel. The amide friction modifier is formed from a hyper-branched fatty acid and an amine. Methods to reduce the frictional property of a fuel and a fuel composition including the amide friction modifier are also disclosed.

54 Claims, No Drawings

METHODS TO IMPROVE THE LOW TEMPERATURE COMPATIBILITY OF AMIDE FRICTION MODIFIERS IN FUELS AND AMIDE FRICTION MODIFIERS

This application is a continuation-in-part of U.S. patent application Ser. No. 10/421,006 filed Apr. 22, 2003 now U.S. Pat. No. 7,435,272 which is a continuation-in-part of U.S. patent application Ser. No. 10/128,529 filed Apr. 24, 2002, now U.S. Pat. No. 6,866,690, both of which are hereby incorporated by reference in their entirety.

BACKGROUND OF THE INVENTION

The present disclosure relates to amide friction modifiers, and more particularly to amide friction modifiers having improved low temperature compatibility with fuels. The present disclosure further relates to fuel compositions including friction modifiers having improved low temperature compatibility, and methods for reducing the friction of a fuel when the fuel is being pumped.

Regulatory mandates requiring the introduction of low sulfur fuels, which are known to be less lubricating, have raised concerns regarding the durability of fuel pumps and injectors. While sulfur itself is not known to be a lubricity modifying agent, the removal of sulfur by deep hydrotreating is known to inadvertently remove natural lubricity components of the fuel, such as certain aromatics, carboxylic acids, and esters. Unfortunately, commercial gasoline detergents and dispersants generally show very little friction reducing characteristics until very high concentrations are added to the fuel. These high detergent concentrations often reach levels where no-harm effects such as combustion chamber deposits (CCD) become unacceptable.

As discussed at some length in U.S. Pat. No. 6,277,158 to McLean, the performance of gasolines and other fuels can be improved through the use of additive technology. It has been suggested that separate friction modifiers can be added to gasoline to increase fuel economy by reducing engine friction. Fuel friction modifiers would also serve to protect high-pressure fuel pumps and injectors, such as those found in direct injection gasoline (DIG) engines, from wear caused by fuel.

In selecting suitable fuel additives it is important to that the additives do not adversely affect engine performance. For example, the additives should not promote valve sticking or cause other performance-reducing problems. To be suitable for commercial use, a friction modifier additive must pass all no-harm testing required for gasoline performance additives. This is often the biggest hurdle for commercial acceptance. The no-harm testing involves 1) compatibility with gasoline and other additives likely to be in gasoline at a range of temperatures, 2) no increase in intake valve deposits (IVD) and CCD, 3) no valve stick at low temperatures, and 4) no corrosion in the fuel system, cylinders, and crankcase. Developing an additive meeting all these criteria is challenging.

Most prior friction modifiers for fuels have been derivatives of natural (plant and animal derived) fatty acids, with only a few purely synthetic products. For example, WO 01/72930 A2 describes a mechanistic proposal for delivery of a fuel born friction modifier to the upper cylinder wall and into the oil sump resulting in upper cylinder/rings and valves lubrication. The friction modifier is packaged with fuel detergent dispersants such as polyetheramines (PEAs), polyisobutene amines (PIBAs), Mannich bases, and succinimides. The WO '930 reference refers to U.S. Pat. Nos. 2,252,889, 4,185,594, 4,208,190, 4,204,481, and 4,428,182, which all describe the use of fuel modifiers in diesel fuel. Chemistries covered by these patents include fatty acid esters, unsaturated dimerized fatty acids, primary aliphatic amines, fatty acid amides of diethanolamine and long-chain aliphatic monocarboxylic acids. Also mentioned therein is U.S. Pat. No. 4,427,562, which discloses a lubricant oil and fuel friction modifier made by reacting primary alkoxyalkylamines with carboxylic acids or by aminolysis of the appropriate formate ester. U.S. Pat. No. 4,729,769 is also referenced and discloses a gasoline carburetor detergent for gasoline compositions derived from reaction products of a $C_6$-$C_{20}$ fatty acid ester, such as coconut oil, and a mono- or di-hydroxy hydrocarbyl amine, such as diethanolamine. The additive in the '769 patent is described as being useful in any gasoline including leaded and those containing methylcyclopentadienyl manganese tricarbonyl (MMT). The fuel described in the '769 patent may contain other necessary additives such as anti-icers, and corrosion inhibitors.

Various other references disclose friction modifying additives for fuels. For example, U.S. Pat. No. 5,858,029 discloses the reaction of primary etheramines with hydrocarboxylic acids to give hydroxyamides that exhibit friction reduction in fuels and lubricants. Other patents describing friction modifiers include U.S. Pat. Nos. 4,617,026 (monocarboxylic acid of ester of a trihydric alcohol, glycerol monooleate as fuels and lubricant friction modifier); U.S. Pat. Nos. 4,789,493, 4,808,196, and 4,867,752 (use of fatty acid formamides); U.S. Pat. No. 4,280,916 (use of fatty acid amides); U.S. Pat. No. 4,406,803 (use of alkane 1,2-diols in lubricants to improve fuel economy); and U.S. Pat. No. 4,512,903 (use of amides from mono- or polyhydroxy substituted aliphatic monocarboxylic acids and amines). U.S. Pat. No. 6,328,771 discloses fuel compositions containing lubricity enhancing salt compositions made by the reaction of certain carboxylic acids with a component that is comprised of a heterocyclic aromatic amine. EP 0 798 364 discloses diesel fuel additives comprising a salt of a carboxylic acid and an aliphatic amine, or an amide obtained by dehydration-condensation between a carboxylic acid and an aliphatic amine. EP 0 869 163 A1 describes a method for reducing engine friction by use of ethoxylated amines. In addition, U.S. Pat. No. 4,086,172 (oil soluble hydroxyamines such as "ETHOMEEN 18-12™ (formula $C_{18}H_{37}N$—$(CH_2CH_2OH)_2$) as lubricant antioxidant); U.S. Pat. No. 4,129,508 (reaction products of succinic acid or anhydride and a polyalkylene glycol or monoether, an organic basic metal, and an alkoxylated amine as a demulsifier); U.S. Pat. Nos. 4,231,883; 4,409,000; and 4,836,829, all teach various uses of hydroxyamines in fuels and lubricants.

U.S. Pat. No. 6,277,158 describes the current practice in the supply of gasoline as generally being to pre-mix the fuel additives into a concentrate in a hydrocarbon solvent base, and then to inject the concentrate into gasoline pipelines used to fill tankers prior to delivery to the customer. To facilitate injection of the concentrate into the gasoline, it is important that the concentrate is in the form of a low viscosity, homogeneous liquid.

SUMMARY OF THE INVENTION

An embodiment of the present disclosure provides a method to improve the low temperature compatibility of an amide friction modifier in a fuel comprising (a) forming a hyper-branched fatty acid amide, and (b) combining the amide with a fuel.

In accordance with another embodiment of the present disclosure, a friction modifier comprises a hyper-branched fatty acid amide.

A further embodiment provides a method for reducing the friction of a fuel when the fuel is being pumped comprising (a) forming a hyper-branched fatty acid amide, and (b) combining the amide with a fuel.

In accordance with yet another embodiment, a fuel composition comprises a major proportion of a fuel and a minor proportion of a friction modifier comprising a hyper-branched fatty acid amide Advantageously, embodiments of the present disclosure provide friction modifying additives which are typically liquid at temperatures as low as −20° C. Accordingly, the friction modifiers of the present disclosure are more compatible with fuels at low temperatures than additives which are not liquid at low temperatures. For example, many amide friction modifiers, including those formed from straight-chain fatty acids, comprise a wax or solid at room temperature. Such additives must therefore be utilized in conjunction with solubilizing agents, such as hydrocarbon solvents, in order to be miscible with fuels at normal operating temperatures. In contrast, friction modifiers according to the present disclosure are miscible with fuels at temperatures as low as −20° C. Accordingly, the presently disclosed friction modifiers may preclude the need for solubilizing agents, simplifying use, reducing costs and avoiding environmental and health concerns often associated with solvent use.

It is to be understood that both the foregoing general description and the following detailed description are exemplary and explanatory only and are intended to provide further explanation of the present disclosure, as claimed.

DETAILED DESCRIPTION OF THE PREFERRED EMBODIMENTS

An embodiment of the present disclosure is directed to improving the low-temperature compatibility of amide friction modifiers with fuels. The method may comprise forming a hyper-branched fatty acid amide, and combining the amide with a fuel. In many embodiments, a hyper-branched fatty acid amide may be formed by contacting, e.g., combining, mixing or reacting, a hyper-branched fatty acid and an amine, and removing water.

Hyper-branched fatty acids which may be utilized to form the amides of the present disclosure may have a variety of structures. As is known, fatty acids, i.e., carboxylic acids, comprise a carboxyl group and an alkyl group. In accordance with the present disclosure, hyper-branched fatty acids may comprise fatty acids which include an alkyl group having at least two substituents on the alpha-carbon (i.e., the carbon adjacent to the carbonyl group), with at least one of the substituents being branched. For example, a hyper-branched fatty acid may have the following general structure:

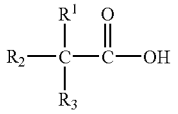

(I)

where at least two of $R_1$, $R_2$, and $R_3$ represent a $C_1$ to $C_{20}$ alkyl group and an alkyl group of at least one of $R_1$, $R_2$, and $R_3$ is branched or cyclic.

While hyper-branched fatty acids may have any of a multitude of configurations, as an example, a hyper-branched fatty acid may have the general structure (I) above, where $R_1$ represents a branched pentyl group, $R_2$ represents hydrogen, and $R_3$ represents a branched hexyl group. An exemplary branched pentyl group may comprise 2,2-dimethyl-4-pentyl and an exemplary branched hexyl group may comprise 2,2,4-trimethyl-6-hexyl. As another example, $R_1$ may represent an isodecyl group, $R_2$ may represent hydrogen, and $R_3$ may represent a methyl group. As yet another example, $R_1$ may represent a methyl group, $R_2$ may represent hydrogen, and $R_3$ may represent an isopropyl group. As a still further example, $R_1$ may represent an isopropyl group, and $R_2$ and $R_3$ may each independently represent a methyl group.

In accordance with some embodiments, hyper-branched fatty acids may have the general structure (I) above, where at least two of $R_1$, $R_2$, and $R_3$ represent a $C_1$ to $C_{20}$ hydrocarbyl group, and at least one of the hydrocarbyl groups is branched or cyclic. Exemplary hydrocarbyl groups may include alkyls, alkylenes, alkenyls, alkenylenes, aryls, alkaryls, aralkyls, and cycloalkyls.

Hyper-branched fatty acids in accordance with the present disclosure may comprise natural or synthetic acids. Exemplary natural acids which in some forms may include hyper-branching include pristanic acid (2,6,10,14-tetramethylpentadecanoic acid) and naphthenic acid (alpha-branched forms). Additional exemplary hyper-branched fatty acids may include, but are not limited to 2,2,3-trimethylbutyric acid, 2-cyclohexylpropanoic acid, 2,2,4,8,10,10-hexamethyl-7-carboxy-undecanoic acid, 3-methyloctahydropentalene-1-carboxylic acid, 2-methylcyclohexane-1-carboxylic acid, 1-methylcyclohexanecarboxylic acid, and 2-norbornanecarboxylic acid.

Without wishing to be bound to any particular theory, it is nonetheless postulated that the provision of hyper-branching, e.g., the provision of at least two alkyl substituents on the alpha-carbon with at least one being branched, in the fatty acid used to form the amide increases the likelihood that the amide is a liquid in a range of temperatures. For example, in many embodiments, the amide is a liquid over at least a temperature range of from about −20° C. to about +35° C. Accordingly, amides prepared from hyper-branched fatty acids are compatible with fuels at temperatures as low as −20° C. In contrast, many conventional friction modifiers are not miscible with fuels at these temperatures.

In accordance with most embodiments, the hyper-branched fatty acid used to form the amide is a saturated compound, i.e., a compound containing only single bonds between carbon molecules. The utilization of saturated hyper-branched fatty acids offers advantages over utilizing unsaturated materials. For example, friction modifiers prepared from saturated hyper-branched fatty acids may avoid the undesirable formation of engine deposits, in contrast with unsaturated materials which can lead to the formation of deposits.

The hyper-branched fatty acid amides according to the present disclosure may be formed using any of a multitude of amines. Exemplary amines may include, but are not limited to ammonia, alkylated amines including mono-, di-, and poly-alkylated amines, alkanolamines, including dialkanolamines, and hydroxyalkyls. In many embodiments, the amine may comprise a dialkanolamine, such as diglycolamine, diethanolamine, dipropanolamine, and 3-aminopropane-1,2-diol. Advantageously, dialkanolamines may produce amides which improve, e.g., reduce, boundary friction coefficients in fluids. Additional exemplary amines may include ethanolamine and n-methylethanolamine.

The hyper-branched fatty acid and amine may be combined in various relative amounts to form the hyper-branched fatty acid amide. For example, the hyper-branched fatty acid and amine may be present in molar ratios of acid to amine ranging from about 1:0.7 to about 1:1. In many embodiments, the hyper-branched fatty acid and amine may be present in a molar ratio of acid to amine of approximately 1:1.

The hyper-branched fatty acid amide may be formed by any of a variety of methods and numerous methods are known in the art. In many embodiments, the hyper-branched fatty acid amide may be formed by contacting the hyper-branched fatty acid and the amine, in an approximately 1:1 molar ratio, in the presence of a hydrocarbon solvent, such as toluene. The mixture of hyper-branched fatty acid, amine, and solvent may be stirred and heated to an elevated temperature ranging from about 130° C. to about 155° C. The temperature may be maintained at the elevated temperature until approximately 1 mol of water has been removed. After the approximately 1 mol of water has been removed, the temperature may be further increased to remove the remaining water and produce the amide.

Another exemplary method of forming hyper-branched fatty acid amides may comprise activating the hyper-branched fatty acid and contacting the activated acid with an amine. Advantageously, these methods often allow lower reaction temperatures to be utilized. Hyper-branched fatty acids may be activated by contact with an activator compound, which typically acts as a dehydrating agent. For example, one class of activator compounds comprises the carbodiimides, such as dicyclohexylcarbodiimide, although many other suitable activating compounds are known to those skilled in the art. A comprehensive disclosure of acid activators is provided in *Comorehensive Organic Transformations*, "A Guide to Functional Group Preparations", Richard C. Larock, VCH Publishers, 1989, pp 972-976, which is incorporated herein by reference. The acid activator may produce activated acids including, but not limited to, hyper-branched fatty acid esters, hyper-branched fatty acid anhydrides, and hyper-branched fatty acid chlorides. Any of numerous other known methods of forming amides may also be utilized to produce the hyper-branched fatty acid amides of the present disclosure.

In many embodiments, the hyper-branched fatty acid amide produced from the hyper-branched fatty acid and amine has the following general structure:

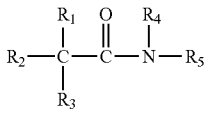

(II)

where at least two of $R_1$, $R_2$, and $R_3$ represents a $C_1$ to $C_{20}$ alkyl group and an alkyl group of at least one of $R_1$, $R_2$, and $R_3$ is branched or cyclic, and $R_4$ and $R_5$ each independently represents hydrogen, an alkyl group, an alkanol, or hydroxyalkyl group.

While hyper-branched fatty acid amides may have any of a multitude of structures, as an example, a hyper-branched fatty acid amide may have the general structure (II) above, where $R_1$, $R_2$, and $R_3$ may represent any of the groups identified above for a hyper-branched fatty acid, e.g., structure (I), and $R_4$ and $R_5$ may each independently represent hydrogen, a methyl group, a hydroxyethyl group, a hydroxypropyl group, a hydroxyethylethylether or propane-diol. For example, in some embodiments $R_4$ and $R_5$ may comprise hydroxyethyl groups or hydroxypropyl groups. In other embodiments, $R_4$ may comprise a hydroxyethyl group or a hydroxypropyl group and $R_5$ may comprise hydrogen or a methyl group. In still further embodiments, $R_4$ may comprise propane-diol and $R_5$ may comprise hydrogen or a methyl group. In yet other embodiments, $R_4$ may comprise hydrogen and $R_5$ may comprise a methyl group.

Hyper-branched fatty acid amides according to the present disclosure may be utilized as friction modifiers in a variety of applications. For example, hyper-branched fatty acid amides may be included in fuel in order to reduce the friction of the fuel when the fuel is being pumped. Additionally or alternatively, the hyper-branched fatty acid amides may comprise a lubricant additive and/or be included in lubricant systems. For example, friction modifiers comprising a hyper-branched fatty acid amide may be added directly or indirectly to an oil, such as crankcase oil.

In many embodiments, the hyper-branched fatty acid amides may be included in a fuel suitable for use in the operation of spark-ignition or compression-ignition internal combustion engines. Exemplary combustible fuels may include leaded or unleaded motor and aviation gasolines, diesel fuel, bio-diesel fuel, i.e., a diesel equivalent processed fuel derived from biological sources, jet fuel, kerosene, so-called "reformulated gasolines" which typically contain both hydrocarbons of the gasoline boiling range and fuel-soluble oxygenated blending agents, such as alcohols, ethers, and other suitable oxygen-containing organic compounds. Exemplary oxygenates may include methanol, ethanol, isopropanol, t-butanol, mixed $C_1$ to $C_5$ alcohols, methyl tertiary butyl ether, tertiary amyl methyl ether, ethyl tertiary butyl ether, and mixed ethers. Oxygenates, when used, will normally be present in the fuel in an amount below about 25% by volume, and preferably in an amount that provides an oxygen content in the overall fuel in the range of about 0.5 to about 5 percent by volume.

According to embodiments of the present disclosure, fuel compositions may comprise a major proportion of a combustible fuel and a minor proportion of a friction modifier comprising a hyper-branched fatty acid amide. The amount of friction modifier included in the fuel composition may vary, but generally will be an amount providing the improved low temperature compatibility and performance effects as described herein. For example, the friction modifier may be present in an amount ranging from about 20 ppm to about 10,000 ppm, for example, an amount ranging from about 100 ppm to about 1,000 ppm, and in some embodiments, may be present in an amount ranging from about 300 ppm to about 500 ppm.

Fuel compositions according to the present disclosure may include additional components. For example, a fuel composition may include a detergent or deposit inhibitor. Deposit inhibitors for gasoline, usually referred to as detergents or dispersants, are well known and a variety of compounds can be used. For example, Mannich bases, which include the reaction products of high molecular weight alkyl-substituted hydroxyaromatic compounds, aldehydes and amines, may be included. Exemplary Mannich base detergents include those taught in U.S. Pat. Nos. 4,231,759; 5,514,190; 5,634,951; 5,697,988; 5,725,612; and 5,876,468, the disclosures of which are incorporated herein by reference. Additional Mannich base detergents include, for example, HiTEC® 4995 and HiTEC® 6410 Detergents (available from Afton Chemical Corporation, Richmond, Va., U.S.A).

Other components which may be included in fuel compositions may include corrosion inhibitors, demulsifying agents, antioxidants, metal deactivators, dyes, markers, biocides, antistatic additives, drag reducing agents, emulsifiers, dehazers, anti-icing additives, octane enhancers, antiknock additives, anti-valve-seat recession additives, surfactants, combustion improvers, carrier fluids, and solvents. In some embodiments, methyl cyclopentadienyl manganese tricarbonyl (MMT) may be included in a fuel composition. The fuel compositions may be formulated by blending the friction modifier and other optional components into the fuel individually or in various sub-combinations.

The fuel compositions according to the present disclosure may be used in any of a multitude of vehicles including internal combustion engines that burn liquid fuel. For example, the presently disclosed fuel compositions may be utilized in vehicles containing spark-ignited gasoline engines that are carbureted, port-fuel injected (PFI), and direct injected, as well as vehicles containing compression-ignited engines such as diesel engines.

EXAMPLE

The practice and advantages of this invention are demonstrated by the following example, which is presented for purposes of illustration and not limitation.

Amide friction modifiers according to the present disclosure were prepared from hyper-branched fatty acids and comparison amide friction modifiers were prepared from "straight-chain" fatty acids, i.e., fatty acids containing no hyper-branching, using the procedure set forth below. The specific fatty acids and amines utilized to form the amide friction modifiers, and the consistency of the resulting reaction products are set forth in Table 1 below.

One mol of fatty acid and 1 mol of amine were combined in a reactor equipped with a Dean Stark trap, mechanical stirring, and nitrogen blanket. Approximately 150 mL of toluene was added to the reactor and additional toluene was added to the trap. The mixture was stirred and solvent was removed until the mixture temperature reached approximately 145° C. The temperature was maintained at approximately 145° C. with continuous stirring, and water was removed until approximately 1 mol of water was collected. (Water removal was used to monitor the extent of reaction, with 1 mol of water produced for every mol of acid consumed.) The temperature was increased to approximately 155° C. and nitrogen flow was increased for approximately 1 to 2 hours to thoroughly drive off the solvent. The resulting reaction product was cooled to 25° C. and the consistency was visually identified.

TABLE 1

| Fatty Acid | Amine | Product Consistency at 25° C. |
|---|---|---|
| Hyper-branched isostearic acid* | Diglycolamine | Liquid |
| Hyper-branched isostearic acid* | 3-aminopropane-1,2-diol | Liquid |
| Straight-chain isostearic acid** | Diglycolamine | Wax |
| Straight-chain isostearic acid** | 3-aminopropane-1,2-diol | Wax |

*available from Nissan Chemical America Corporation, Houston, Texas
**available from Arizona Chemical Company, Jacksonville, Florida.

The above results clearly demonstrate that hyper-branched fatty acids yield amide products that are liquid at room temperature, while conventional straight-chain fatty acids result in wax amide products at room temperature. Accordingly, the hyper-branched fatty acid amides of the present disclosure provide numerous advantages over conventional friction modifiers. One significant advantage is the improved low temperature compatibility with fuels. Since hyper-branched fatty acid amides are liquid at normal engine operating temperatures, they are easily miscible with fuels. As an additional advantage, hyper-branched fatty acid amides may be utilized without the use of solubilizing agents. Avoiding the use of solubilizing agents not only simplifies operations, but reduces costs, and eliminates environmental and health concerns often associated with solvent use.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus, the reactants and components are identified as ingredients to be brought together either in performing a desired chemical reaction (such as a Mannich condensation reaction) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations is thus wholly immaterial for an accurate understanding and appreciation of this disclosure and the claims thereof.

At numerous places throughout this specification, reference has been made to a number of patents and patent applications. All such cited documents are expressly incorporated in full into this disclosure as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A method to improve the low temperature compatibility of an amide friction modifier in a fuel, said method comprising combining a hyper-branched fatty acid amide with a fuel, wherein the hyper-branched fatty acid amide has the following structure:

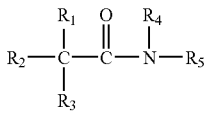

where at least two of $R_1$, $R_2$, and $R_3$ represents a $C_1$ to $C_{20}$ alkyl group and the remaining of $R_1$, $R_2$ and $R_3$ represents a $C_1$ to $C_{20}$ alkyl group or hydrogen, where the $C_1$ to $C_{20}$ alkyl group of at least one of $R_1$, $R_2$, and $R_3$ is branched or cyclic, and where $R_4$, and $R_5$ each independently represents hydrogen, an alkyl group, an alkanol, or hydroxyalkyl group.

2. The method of claim 1, where $R_1$ represents 2,2,4-trimethyl-6-hexyl, $R_2$ represents hydrogen, and $R_3$ represents 2,2-dimethyl-4-pentyl.

3. The method of claim 1, where $R_1$ represents an isodecyl group, $R_2$ represents hydrogen, and $R_3$ represents a methyl group.

4. The method of claim 1, where $R_1$ represents a methyl group, $R_2$ represents hydrogen, and $R_3$ represents an isopropyl group.

5. The method of claim 1, where $R_1$ represents an isopropyl group, and $R_2$ and $R_3$ each independently represents a methyl group.

6. The method of claim 2, where $R_4$ and $R_5$ may be the same or different, and each independently represents hydrogen, a methyl group, a hydroxyethyl group, a hydroxypropyl group, a hydroxyethylethylether or propane-diol.

7. The method of claim 6, where $R_4$ represents a hydroxyethylethylether and $R_5$ represents a methyl group or hydrogen.

8. The method of claim 6, where $R_4$ represents propane-diol and $R_5$ represents a methyl group or hydrogen.

9. The method of claim 1, wherein the hyper-branched fatty acid is selected from the group consisting of 2,6,10,14-tetramethylpentadecanoic acid, alpha-branched naphthenic acid, 2,2,3-trimethylbutyric acid, 2-cyclohexylpropanoic acid, 2,2,4,8,10,10-hexamethyl-7-carboxy-undecanoic acid, 3-methyloctahydropentalene-1-carboxylic acid, 2-methylcyclohexane-1-carboxylic acid, 1-methylcyclohexanecarboxylic acid, and 2-norbornanecarboxylic acid.

10. The method of claim 9, wherein the amine is selected from the group consisting of ammonia, alkylated amines, alkanolamines, and hydroxyalkylamines.

11. The method of claim 9, wherein said contacting the hyper-branched fatty acid with an amine comprises contacting the hyper-branched fatty acid with the amine in a molar ratio of fatty acid to amine ranging from about 1:0.7 to about 1:1.

12. The method of claim 9, wherein said contacting the hyper-branched fatty acid with an amine comprises contacting the hyper-branched fatty acid with the amine in a molar ratio of fatty acid to amine of about 1:1.

13. The method of claim 1, further comprising forming the hyper-branched fatty acid amide, said forming of the hyper-branched fatty acid amide comprising (a) activating a hyper-branched fatty acid, and (b) contacting the activated hyper-branched fatty acid with an amine.

14. The method of claim 13, wherein the activated hyper-branched fatty acid is selected from the group consisting of hyper-branched fatty acid esters, hyper-branched fatty acid anhydrides, and hyper-branched fatty acid chlorides.

15. The method of claim 1, wherein the fuel is at least one selected from the group consisting of gasoline, jet fuel, kerosene, diesel fuel, biodiesel fuel, an alcohol-containing fuel, and an ethanol-gasoline blend.

16. A friction modifier comprising a hyper-branched fatty acid amide, wherein the hyper-branched fatty acid amide has the following structure:

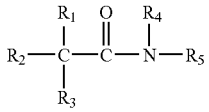

where at least two of $R_1$, $R_2$, and $R_3$ represents a $C_1$ to $C_{20}$ alkyl group and the remaining of $R_1$, $R_2$ and $R_3$ represents a $C_1$ to $C_{20}$ alkyl group or hydrogen, where the $C_1$ to $C_{20}$ alkyl group of at least one of $R_1$, $R_2$, and $R_3$ is branched or cyclic, and where $R_4$, and $R_5$ each independently represents hydrogen, an alkyl group, an alkanol, or hydroxyalkyl group.

17. The friction modifier of claim 16, where $R_1$ represents 2,2,4-trimethyl-6-hexyl, $R_2$ represents hydrogen, and $R_3$ represents 2,2-dimethyl-4-pentyl.

18. The friction modifier of claim 16, where $R_1$ represents an isodecyl group, $R_2$ represents hydrogen, and $R_3$ represents a methyl group.

19. The friction modifier of claim 16, where $R_1$ represents a methyl group, $R_2$ represents hydrogen, and $R_3$ represents an isopropyl group.

20. The friction modifier of claim 16, where $R_1$ represents an isopropyl group, and $R_2$ and $R_3$ each independently represents a methyl group.

21. The friction modifier of claim 16, where $R_4$ and $R_5$ may be the same or different and each independently represents hydrogen, a methyl group, a hydroxyethyl group, a hydroxypropyl group, a hydroxyethylethylether or propane-diol.

22. The friction modifier of claim 21, where $R_4$ represents a hydroxyethylethylether and $R_5$ represents a methyl group or hydrogen.

23. The friction modifier of claim 21, where $R_4$ represents propane-diol and $R_5$ represents a methyl group or hydrogen.

24. The friction modifier of claim 16, wherein the hyper-branched fatty acid amide is formed by (a) contacting a hyper-branched fatty acid with an amine, and (b) removing water.

25. The friction modifier of claim 24, wherein the hyper-branched fatty acid is selected from the group consisting of 2,6,10,14-tetramethylpentadecanoic acid, alpha-branched naphthenic acid, 2,2,3-trimethylbutyric acid, 2-cyclohexylpropanoic acid, 2,2,4,8,10,10-hexamethyl-7-carboxy-undecanoic acid, 3-methyloctahydropentalene-1-carboxylic acid, 2-methylcyclohexane-1-carboxylic acid, 1-methylcyclohexanecarboxylic acid, and 2-norbornanecarboxylic acid.

26. The friction modifier of claim 16, wherein the hyper-branched fatty acid amide is formed by (a) activating a hyper-branched fatty acid, and (b) contacting the activated hyper-branched fatty acid with an amine.

27. The friction modifier of claim 26, wherein the activated hyper-branched fatty acid is selected from the group consisting of hyper-branched fatty acid esters, hyper-branched fatty acid anhydrides, and hyper-branched fatty acid chlorides.

28. A method for reducing the friction of a fuel when the fuel is being pumped, said method comprising combining a hyper-branched fatty acid amide with a fuel, wherein the hyper-branched fatty acid amide has the following structure:

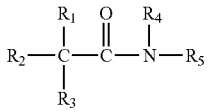

where at least two of $R_1$, $R_2$, and $R_3$ represents a $C_1$ to $C_{20}$ alkyl group and the remaining of $R_1$, $R_2$ and $R_3$ represents a $C_1$ to $C_{20}$ alkyl group or hydrogen, where at least one of $R_1$, $R_2$, and $R_3$ is branched or cyclic, and where $R_4$ and $R_5$ each independently represents hydrogen, an alkyl group, an alkanol or hydroxyalkyl group.

29. The method of claim 28, where $R_1$ represents 2,2,4-trimethyl-6-hexyl, $R_2$ represents hydrogen, and $R_3$ represents 2,2-dimethyl-4-pentyl.

30. The method of claim 28, where $R_1$ represents an isodecyl group, $R_2$ represents hydrogen, and $R_3$ represents a methyl group.

31. The method of claim 28, where $R_1$ represents a methyl group, $R_2$ represents hydrogen, and $R_3$ represents an isopropyl group.

32. The method of claim 28, where $R_1$ represents an isopropyl group, and $R_2$ and $R_3$ each independently represents a methyl group.

33. The method of claim 28, where $R_4$ and $R_5$ may be the same or different, and each independently represents hydrogen, a methyl group a hydroxyethyl group, a hydroxypropyl group, a hydroxyethylethylether or propane-diol.

34. The method of claim 28, where $R_4$ represents hydroxyethylethylether and $R_5$ represents a methyl group or hydrogen.

35. The method of claim 28, further comprising forming the hyper-branched fatty acid amide, said forming of the hyper-branched fatty acid amide comprising (a) contacting a hyper-branched fatty acid with an amine, and (b) removing water.

36. The method of claim 35, wherein the amine is selected from the group consisting of ammonia, alkylated amines, alkanolamines, and hydroxyalkylamines.

37. The method of claim 35, wherein said contacting the hyper-branched fatty acid with an amine comprises contacting the hyper-branched fatty acid with the amine in a molar ratio of fatty acid to amine ranging from about 1:0.7 to about 1:1.

38. The method of claim 35, wherein said contacting the hyper-branched fatty acid with an amine comprises contacting the hyper-branched fatty acid with the amine in a molar ratio of fatty acid to amine of about 1:1.

39. The method of claim 28, further comprising forming the hyper-branched fatty acid amide, said forming of the hyper-branched fatty acid amide comprising (a) activating a hyper-branched fatty acid, and (b) contacting the activated fatty acid with an amine.

40. The method of claim 39, wherein the activated hyper-branched fatty acid is selected from the group consisting of hyper-branched fatty acid esters, hyper-branched fatty acid anhydrides, and hyper-branched fatty acid chlorides.

41. The method of claim 28, wherein the fuel is at least one selected from the group consisting of gasoline, jet fuel, kerosene, diesel fuel, biodiesel fuel, an alcohol-containing fuel, and an ethanol-gasoline blend.

42. A fuel composition comprising a major proportion of a fuel and a minor proportion of a friction modifier comprising a hyper-branched fatty acid amide, wherein the hyper-branched fatty acid amide has the following structure:

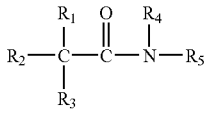

where at least two of $R_1$, $R_7$, and $R_3$ represents a $C_1$ to $C_{20}$ alkyl group and the remaining of $R_1$, $R_2$ and $R_3$ represents a $C_1$ to $C_{20}$ alkyl group or hydrogen, where at least one of $R_1$, $R_2$, and $R_3$ is branched or cyclic, and where $R_4$ and $R_5$ each independently represents hydrogen, an alkyl group, an alkanol or hydroxyalkyl group.

43. The fuel composition of claim 42, wherein the minor proportion of the friction modifier comprises from about 20 ppm to about 10,000 ppm friction modifier.

44. The fuel composition of claim 43, wherein the minor proportion of the friction modifier comprises from about 100 ppm to about 1,000 ppm friction modifier.

45. The fuel composition of claim 44, wherein the minor proportion of the friction modifier comprises from about 300 ppm to about 500 ppm friction modifier.

46. The fuel composition of claim 42, where $R_1$ represents 2,2,4-trimethyl-6-hexyl, $R_2$ represents hydrogen, and $R_3$ represents 2,2-dimethyl-4-pentyl.

47. The fuel composition of claim 42, where $R_1$ represents an isodecyl group, $R_2$ represents hydrogen, and $R_3$ represents a methyl group.

48. The fuel composition of claim 42, where $R_1$ represents a methyl group, $R_2$ represents hydrogen, and $R_3$ represents an isopropyl group.

49. The fuel composition of claim 42, where $R_1$ represents an isopropyl group, and $R_2$ and $R_3$ each, independently represents a methyl group.

50. The fuel composition of claim 42, where $R_4$ and $R_5$ may be the same or different and each independently represents hydrogen, a methyl group a hydroxyethyl group, a hydroxypropyl group, a hydroxyethylethylether or propane-diol.

51. The fuel composition of claim 50, where $R_4$ represents hydroxyethylethylether and $R_5$ represents a methyl group or hydrogen.

52. The fuel composition of claim 42, wherein the fuel is at least one selected from the group consisting of gasoline, jet fuel, kerosene, diesel fuel, biodiesel fuel, an alcohol-containing fuel, and an ethanol-gasoline blend.

53. The fuel composition of claim 42 further comprising one or more additional additives selected from the group consisting of dispersants, detergents, corrosion inhibitors, demulsifying agents, antioxidants, metal deactivators, dyes, markers, biocides, antistatic additives, drag reducing agents, emulsifiers, dehazers, anti-icing additives, octane enhancers, antiknock additives, anti-valve-seat recession additives, surfactants, combustion improvers, carrier fluids, and solvents.

54. A vehicle containing or combusting the fuel composition of claim 42.

* * * * *